US007461796B2

(12) United States Patent
Yamaguchi

(10) Patent No.: US 7,461,796 B2
(45) Date of Patent: Dec. 9, 2008

(54) SPRAY NOZZLE

(75) Inventor: Takahiro Yamaguchi, Shizuoka (JP)

(73) Assignee: Nippon Vinylon Co., Ltd., Shizuoka (JP)

( * ) Notice: Subject to any disclaimer, the term of this patent is extended or adjusted under 35 U.S.C. 154(b) by 35 days.

(21) Appl. No.: 11/475,056

(22) Filed: Jun. 27, 2006

(65) Prior Publication Data

US 2006/0289677 A1 Dec. 28, 2006

(30) Foreign Application Priority Data

Jun. 28, 2005 (JP) ..... 2005-188109

(51) Int. Cl.
*B05B 1/10* (2006.01)

(52) U.S. Cl. ..... 239/284.1; 239/284.2; 239/131; 239/589.1

(58) Field of Classification Search ..... 239/248.1, 239/589.1, 284.2, 284.1
See application file for complete search history.

(56) References Cited

U.S. PATENT DOCUMENTS 4,212,425 A * 7/1980 Schlick ..... 239/133
5,636,794 A * 6/1997 Hess et al. ..... 239/284.1
5,857,624 A * 1/1999 Lee ..... 239/284.1
5,975,431 A * 11/1999 Harita et al. ..... 239/284.1
6,082,636 A * 7/2000 Yoshida et al. ..... 239/284.1
6,113,006 A * 9/2000 Walker et al. ..... 239/284.1
6,315,221 B1 * 11/2001 Goenka et al. ..... 239/589
6,354,515 B1 * 3/2002 Matsumoto et al. ..... 239/284.1
6,508,414 B2 * 1/2003 Matsumoto et al. ..... 239/284.1
6,761,323 B2 * 7/2004 Hsieh ..... 239/284.1
6,948,513 B2 * 9/2005 Steerman et al. ..... 137/15.18
7,111,793 B2 * 9/2006 Maruyama et al. ..... 239/284.1
2003/0089409 A1 * 5/2003 Morimoto ..... 137/859
2003/0178506 A1 * 9/2003 Kondou ..... 239/284.1
2003/0234303 A1 * 12/2003 Berning et al. ..... 239/589.1

FOREIGN PATENT DOCUMENTS

JP 2002-096718 4/2002

* cited by examiner

*Primary Examiner*—Len Tran
*Assistant Examiner*—Trevor E. McGraw
(74) *Attorney, Agent, or Firm*—Wenderoth, Lind & Ponack, L.L.P.

(57) ABSTRACT

A spray nozzle, with which the position at which the spray fluid strikes a target does not change, includes an ejection port elongated from side to side, a flow path formed cylindrical between a supply port and the ejection port, the flow path having a taper section formed at the middle thereof to reduce the flow path cross-sectional area gradually toward the ejection port. The taper section has upper and lower apex ends at an end portion on the ejection port side that are offset with respect to each other in the direction of the axis of the flow path.

5 Claims, 5 Drawing Sheets

SPRAY NOZZLE

BACKGROUND OF THE INVENTION

1. Field of the Invention

The present invention relates to a spray nozzle, used as an automobile windshield washer fluid nozzle or the like.

2. Related Art

A conventional spray nozzle 10 is known in which, as shown in FIG. 8A, the spray fluid enters a flow path 12 from a supply port 11 located at the rear of the nozzle, wherein the cross-sectional area of the flow path is reduced at an intermediate point and the flow restricted, and the spray fluid is guided by exit dispersion guide planes 13, 14 and sprayed from an ejection port 15 onto a target such as a windshield or the like (see, for example, JP-A-2002-96718).

However, with the conventional spray nozzle, as shown in FIGS. 8B and 8C, when the spray fluid flows along the inner circumferential wall surface of the flow path 12 and arrives at the point of restriction, the streams of the flow strike each other in disarray and are ejected from the ejection port 15 irregularly along one or the other of the dispersion guide planes 13, 14. As a result, with each ejection the position at which the fluid strikes its target changes. Consequently, stabilizing the position at which the fluid is sprayed is desirable.

SUMMARY OF THE INVENTION

Accordingly, the present invention is conceived as a solution to the foregoing problem.

To solve the foregoing problem and achieve the object of the present invention, the invention provides a spray nozzle comprising an ejection port elongated from side to side, a flow path formed cylindrical between a supply port and the ejection port, the flow path having a taper section formed at the middle thereof to reduce the flow path cross-sectional area gradually toward the ejection port. The taper section has upper and lower end positions on the ejection port side that are offset with respect to each other in the direction of the axis of the flow path.

Preferably a substantially horizontal dispersion plane part extending along the axis is provided at least ahead of a flow stream produced by the one of the upper and lower inner circumferential wall surfaces of the taper section whose end position in the direction of the axis of the flow path is closer to the ejection port than that of the other of the upper and lower inner circumferential wall surfaces of the taper section.

Preferably, the dispersion plane part is offset in a direction perpendicular to the axis of the flow path so as not to guide the spray fluid at a location ahead of a flow stream produced by the one of the upper and lower inner circumferential wall surfaces of the taper section whose end position in the direction of the axis of the flow path is farther from the ejection port.

The spray nozzle of the present invention is configured such that the respective streams of the spray fluid flow along the upper and lower inner circumferential wall surfaces of the taper section are gradually constricted toward the ejection port so that the streams of the flow strike each other, with the streams of the spray fluid flowing along the one of the upper and lower inner circumferential wall surfaces of the taper section whose end position in the direction of the axis of the flow path is closer to the ejection port being decided first, so that, for example, if the spray fluid flowing from top to bottom is sent first, the spray fluid is sprayed with uniform thickness along the shape of the lower portion of the ejection port without flutter.

If a substantially horizontal dispersion plane part along the axis is provided at least ahead of a flow stream produced by upper or lower inner circumferential wall surface of the taper section whose end position in the direction of the axis of the flow path is closer to the ejection port, the spray fluid is sprayed horizontally with uniform thickness along the dispersion plane without flutter.

In addition, if a dispersion plane part is offset in a direction perpendicular to the axis of the flow path so as not to guide the spray fluid ahead of a flow stream produced by upper or lower inner circumferential wall surface of the taper section whose end position in the direction of the axis of the flow path is farther from the ejection port, the offset dispersion plane has no excessive effect on the flow of spray fluid, which is guided only by the horizontal dispersion plane. As a result, the position at which the spray fluid strikes the target does not change with each ejection.

Other features and advantages of the present invention will be apparent from the following description when taken in conjunction with the accompanying drawings, in which like reference characters designate the same or similar parts throughout the figures thereof.

DETAILED DESCRIPTION OF THE PREFERRED EMBODIMENTS

A detailed description will now be given of a preferred embodiment of the present invention, with reference to the accompanying drawings.

Figure 1:
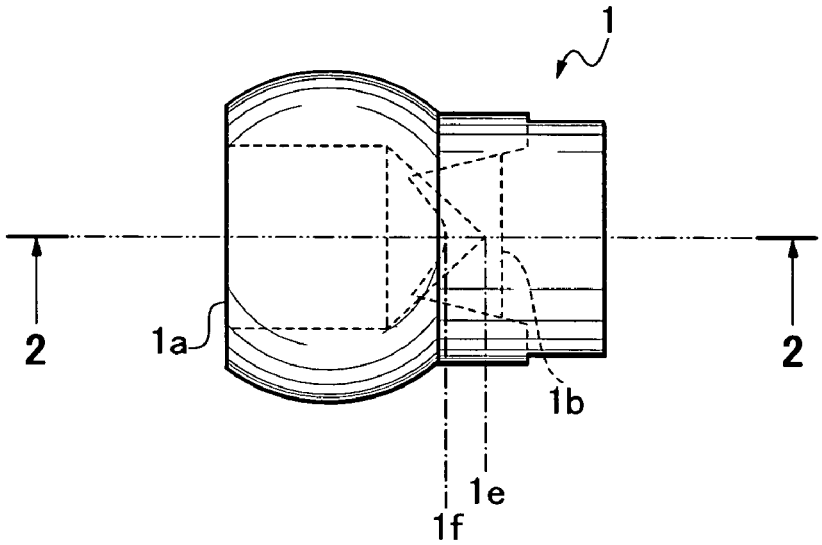
FIG. 1 is a plan view of a spray nozzle according to one embodiment of the present invention.
Figure 2:
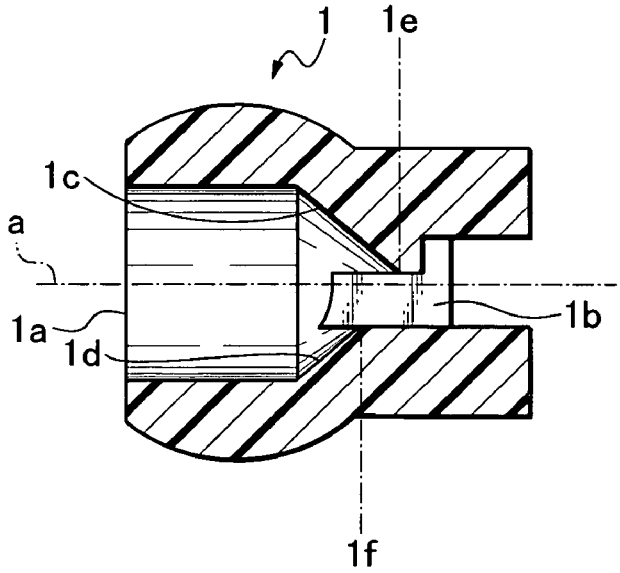
FIG. 2 is a sectional view along a line 2-2 shown in FIG. 1.

A spray nozzle 1 according to the present invention is used, for example, as a washer nozzle for spraying cleaner fluid onto the front windshield of an automobile. As shown in FIGS. 1 and 2, in a flow path extending from a supply port 1*a* to an ejection port 1*b* that is elongated from side to side, a gradually narrowed taper section is formed by upper and lower halves of tapered inner circumferential wall surfaces 1*c*, 1*d* (that together form a substantially conical wall) that reduce the flow path cross-sectional area gradually and, at their tip ends, reach the ejection port 1*b*. The upper and lower end positions 1*e* and 1*f* of the tapered wall surfaces 1*c*, 1*d* at end portions on the ejection port side are offset with respect to each other in the direction of the axis of the flow path. In the embodiment shown in the drawings, the upper end position (apex end) 1*e*, as shown in FIG. 2, is disposed closer to the ejection port 1*b* than the lower end position (apex end) 1*f*.

It should be noted that, with respect to positions 1*e*, 1*f*, it is a matter of design preference which of these is positioned closer to the ejection port 1*b*, as is rotating the spray nozzle 1 by its supporting portion. Moreover, the extent of the offset of the positions 1*e*, 1*f* along the axis of the flow path is set appropriately according to relations between inclination degrees of the tapered wall surfaces 1*c*, 1*d* and the spouting rate of the spray fluid 2, and the like.

Figure 3A:
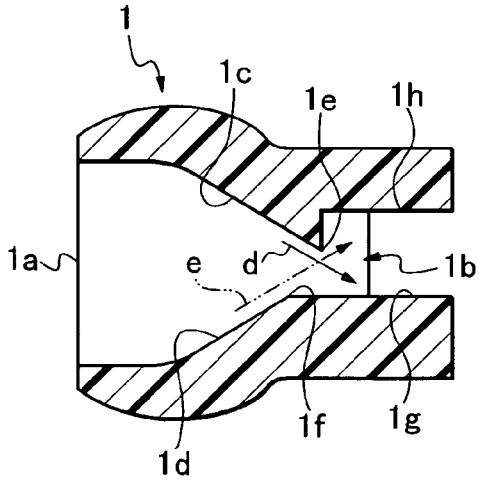
FIGS. 3A and 3B are sectional views illustrating schematically a flow of a spray 5 fluid on a flow path of the spray nozzle.
Figure 3B:
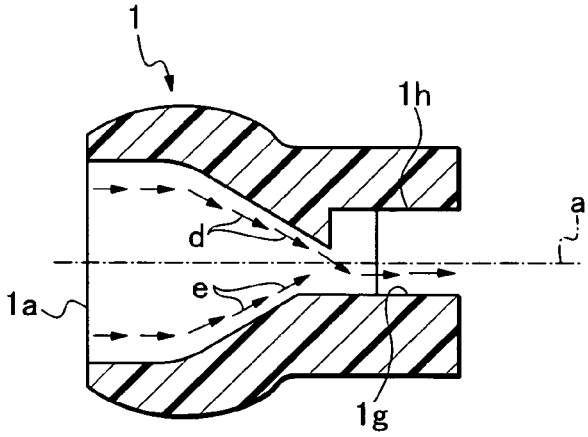

In addition, as shown in FIG. 3A, a substantially horizontal dispersion plane part 1*g* along the axis "a" is provided ahead of a flow stream "d" produced by upper inner circumferential wall surface 1*c* of the taper section whose end position 1*e* in the direction of the axis of the flow path is closer to the ejection port 1*b*. The dispersion plane part 1*g* extends horizontally from the end position 1*e* to the lower section of the ejection port 1*b*.

Figure 4A:
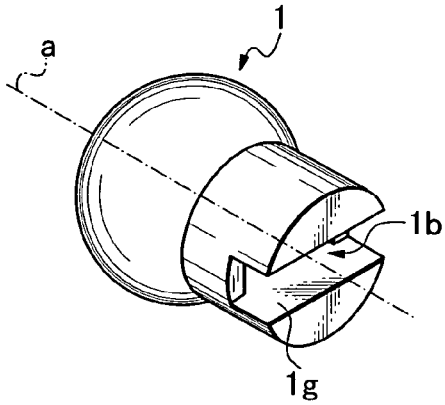
FIG. 4A is a perspective view of the spray nozzle.
Figure 4B:
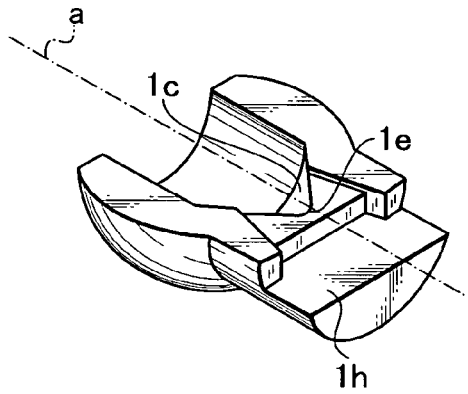
FIGS. 4B and 4C are perspective views of an upper half and a lower half, respectively, showing the spray nozzle cut horizontally along its center.
Figure 4C:
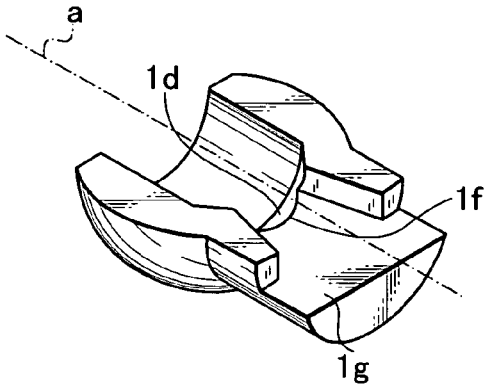

As shown in FIGS. 4A and 4C, the dispersion plane part 1*g* broadens laterally as it extends in a direction away from the ejection port 1*b*. Further, as shown in FIG. 3A, a dispersion plane part 1*h* is offset in a direction perpendicular to the axis "a" of the flow path (in the drawing, the dispersion plane 1*h* is offset upwardly above the axis) so as not to guide the spray fluid ahead of a flow stream "e" produced by the lower inner circumferential wall surface 1*d* of the taper section whose end position 1*f* in the direction of the axis of the flow path is farther from the ejection port 1*b*. Depending on the circumstances, the dispersion plane part 1*h* may be dispensed with.

Figure 5A:
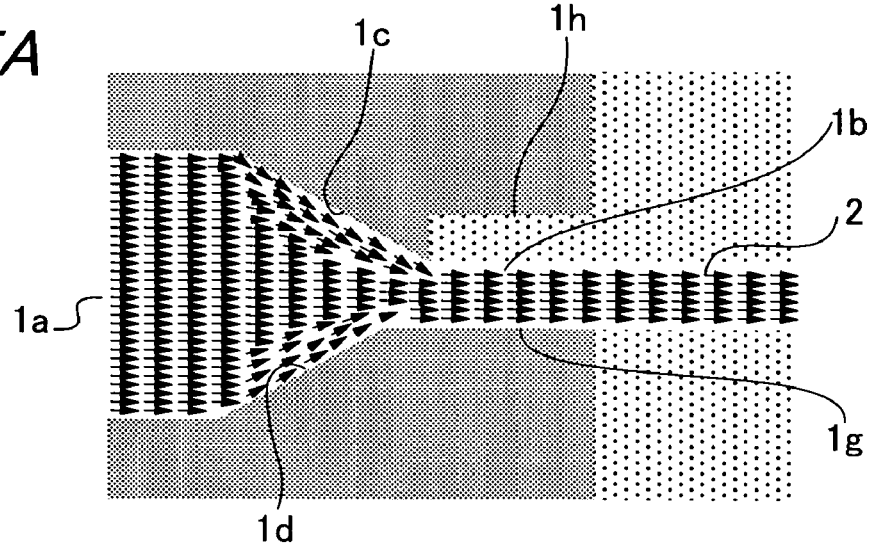
FIG. 5A is a diagram illustrating results of an analysis of the flow of the spray fluid in the spray nozzle, with FIG. 5B showing a partial enlarged view thereof.
Figure 5B:
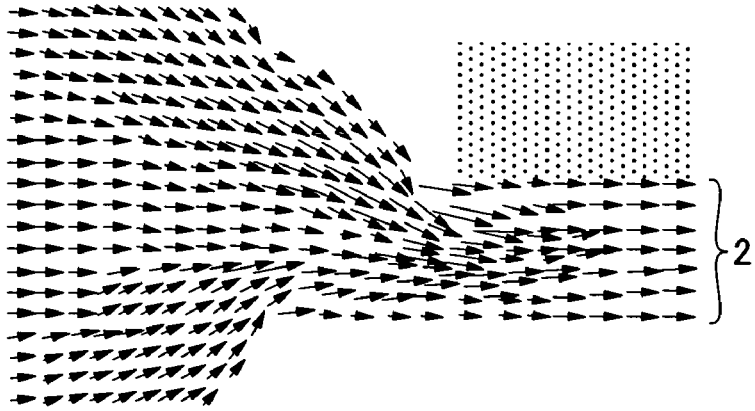

When the state of the fluid ejection of the spray nozzle 1 constructed as described above is tested, as shown in FIG. 5A and in the partial, enlarged detail view shown in FIG. 5B, the speed of the flow increases from the supply port 1*a* along the gradually narrowed taper section 1*c*, 1*d* to the ejection port 1*b* and the rectified spray fluid 2 is ejected along the dispersion plane 1*g*.

The foregoing is a result of the top-side spray fluid that flows along the upper inner circumferential wall surface 1*c* restraining the bottom-side spray fluid that flows along the lower inner circumferential wall surface 1*d* to be guided by the dispersion plane 1*g*.

The above-described top-side spray fluid and bottom-side spray fluid press on the spray fluid flowing through the center. The upper dispersion plane 1*h* is offset markedly upward, and therefore does not affect the flow of the spray fluid 2 from the ejection port 1*b*.

Figure 6:
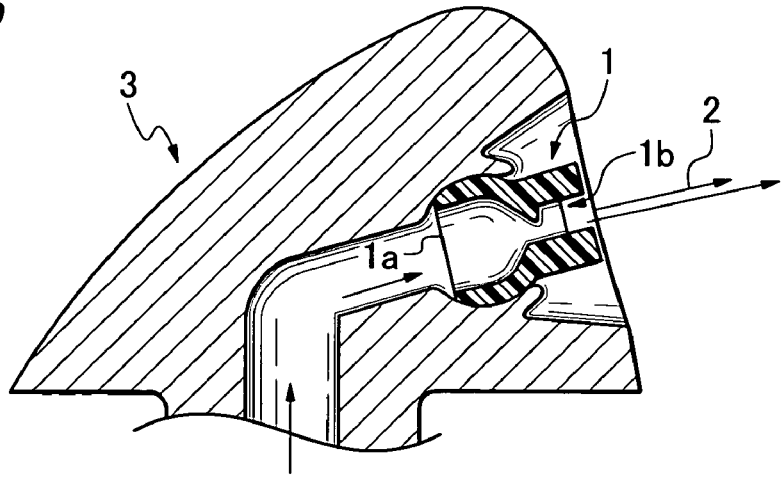
FIG. 6 is a vertical sectional view of the spray nozzle in a state of use.
Figure 7:
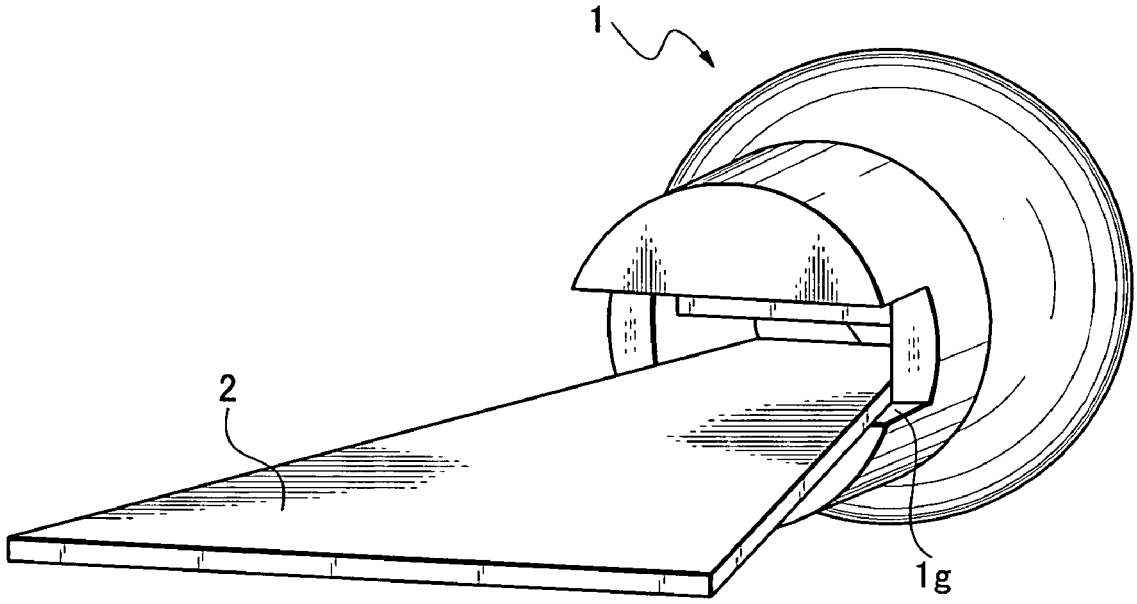
FIG. 7 is a perspective view of the spray nozzle in a state of spraying.
Figure 8A:
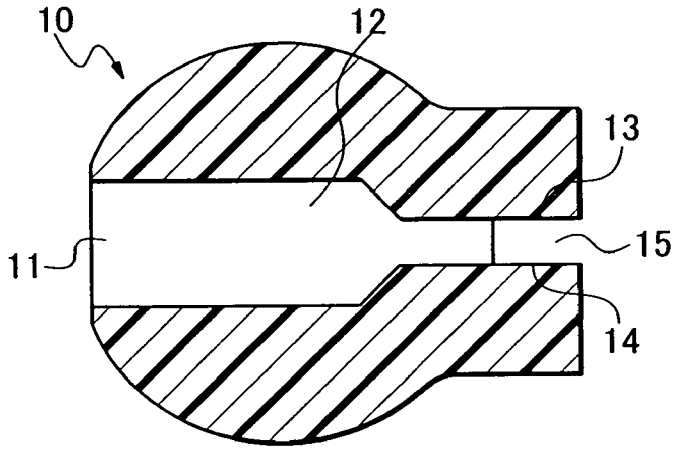
Fig. 8A PRIOR ART
FIG. 8A is a vertical sectional view of a conventional spray nozzle, with FIGS. 8B and 8C illustrating the flow of respective streams of spray fluid.
Figure 8B:
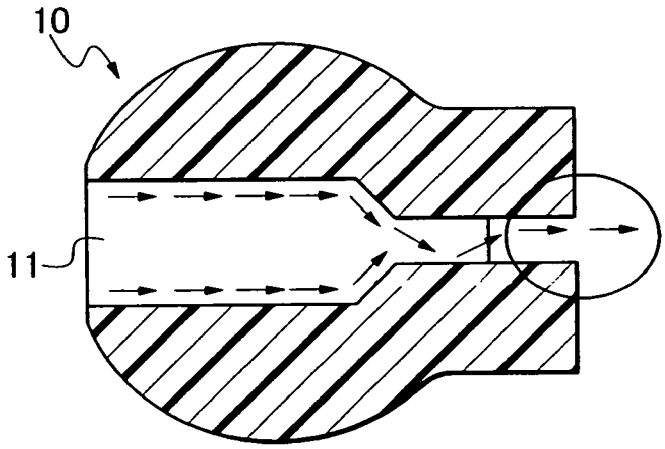
Fig. 8B PRIOR ART
Figure 8C:
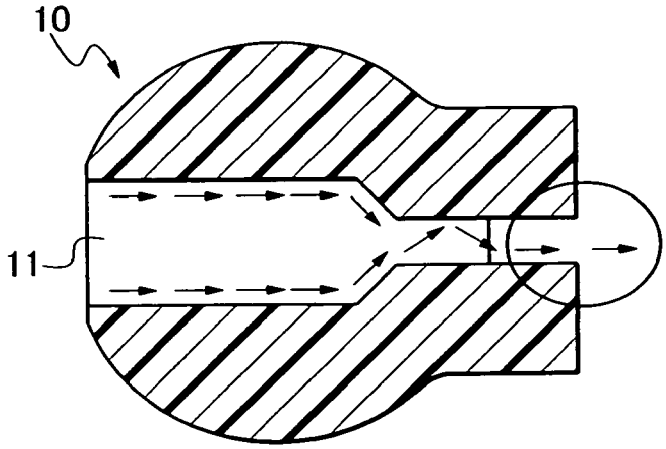
Fig. 8C PRIOR ART

The spray nozzle 1 constructed as described above is, for example, as shown in FIG. 6, pressed into engagement in a spherical seat support part in an ejection port part of a washer nozzle 3 of an automobile. Then, by supplying spray fluid to the supply port 1*a* with a supply pump, as shown in FIG. 7 the spray fluid 2 that flows along the dispersion plane 1*g* of the spray nozzle 1 forms a plane of substantially uniform thickness and is sprayed stably without flutter.

As many apparently widely different embodiments and variations of the present invention can be made without departing from the spirit and scope thereof, it is to be understood that the present invention is not limited to the specific embodiments thereof described herein but rather only to the extent set forth in the following claims.

What is claimed is:

1. A spray nozzle comprising an inlet, an outlet, and a flow passage formed between said inlet and said outlet, said flow passage including:

an inlet port section defined by an inwardly-facing, substantially cylindrical wall that extends from said inlet toward said outlet, said substantially cylindrical wall having a cylinder axis that defines an axis of said flow passage;

an ejection port section defined by mutually-facing, substantially flat walls that extend from said outlet toward said inlet; and a tapered section formed between said inlet port section and said ejection port section;

wherein said tapered section is defined by an inwardly-facing, substantially conical wall having a base portion that connects with said inlet port section, and an apex portion that connects with said ejection port section;

wherein a cross-sectional area of said tapered section is gradually reduced toward said ejection port section;

wherein said substantially conical wall has an upper half and a lower half, and each of said upper and lower halves of said substantially conical wall has a base end and an apex end; and wherein said apex end of said upper half of said substantially conical wall is offset, in a direction of said axis of said flow passage, from said apex end of said lower half of said substantially conical wall, such that said apex end of one of said upper and lower halves of said substantially conical wall is closer to said outlet than is said apex end of the other of said upper and lower halves of said substantially conical wall.

2. The spray nozzle according to claim 1, wherein said one of said upper and lower halves of said substantially conical wall that is closer to said outlet is operable to produce a flow stream that flows in a direction toward a dispersion plane part defined by one of said substantially flat walls of said ejection port section.

3. The spray nozzle according to claim 2, wherein the other of said substantially flat walls of said ejection port section is offset outwardly, in a direction perpendicular to said axis of said flow passage, from said apex end of said one of said upper and lower halves of said substantially conical wall that is closer to said outlet.

4. The spray nozzle according to claim 1, wherein said one of said upper and lower halves of said substantially conical wall that is closer to said outlet is operable to produce a first flow stream flowing in a direction toward a dispersion plane part defined by one of said substantially flat walls of said ejection port section that is on a side of said axis of said flow passage opposite said one of said upper and lower halves of said substantially conical wall, that restrains a second flow stream produced by the other of said upper and lower halves of said substantially conical wall.

5. The spray nozzle according to claim 4, wherein the other of said substantially flat walls of said ejection port section is offset outwardly, in a direction perpendicular to said axis of said flow passage, from said apex end of said one of said upper and lower halves of said substantially conical wall that is closer to said outlet.

* * * * *